US005233706A

United States Patent [19]

Maehr

[11] Patent Number: 5,233,706

[45] Date of Patent: Aug. 10, 1993

[54] WATER CONSERVING SHOWER APPARATUS

[76] Inventor: Jeffrey T. Maehr, 552 S. Euclid, #1, Pasadena, Calif. 91101

[21] Appl. No.: 818,150

[22] Filed: Jan. 8, 1992

[51] Int. Cl.[5] ..... A47K 3/22

[52] U.S. Cl. ..... 4/596; 4/598

[58] Field of Search ..... 4/597, 598, 602, 603, 4/604, 605, 611, 596

[56] References Cited

U.S. PATENT DOCUMENTS 3,646,618 3/1972 Johnson ..... 4/597 X
4,512,044 4/1985 Clark ..... 4/611 X

FOREIGN PATENT DOCUMENTS 3436941 4/1986 Fed. Rep. of Germany ..... 4/603
0194625 9/1986 Fed. Rep. of Germany ..... 4/597
2459643 2/1981 France ..... 4/597
2565811 12/1985 France ..... 4/597

*Primary Examiner*—Charles E. Phillips
*Attorney, Agent, or Firm*—Hugh E. Smith

[57] ABSTRACT

A shower stall includes a drain, wherein the drain includes a slide plate to selectively direct fluid to a sewage or selectively to a reservoir, wherein the reservoir includes a heater and pump assembly therewithin to effect heating and recirculating of the fluid from the reservoir. A modification of the invention includes the shower stall arranged to include a pneumatic or foam filled mattress, wherein the mattress is formed with drainage canals therealong to direct fluid to the floor drain and wherein the shower head is formed as a portion of a manifold assembly slidably directed along guide tracks to provide for displacement of the shower assembly relative to the shower stall.

5 Claims, 5 Drawing Sheets

WATER CONSERVING SHOWER APPARATUS

BACKGROUND OF THE INVENTION

1. Field of the Invention

The field of invention relates to shower apparatus, and more particularly pertains to a new and improved water conserving shower apparatus wherein the same is directed to the recirculating availability of water minimizing wastage thereof.

2. Description of the Prior Art

The recycling of water, particularly in areas of limited water availability, is an ever increasing concern in contemporary society. Prior art structure directed to the conservation of water is exemplified in U.S. Pat. No. 4,924,536 to Houghton wherein a storage tank is arranged to resupply a water heater spaced from the storage tank for replenishment of water within a building.

U.S. Pat. No. 4,110,849 to Lafaver sets forth an apparatus for conserving water relative to a water closet in a commode structure.

U.S. Pat. No. 4,554,688 to Puccerella sets forth a water saving system utilizing water recirculating through various water temperature sensing devices.

U.S. Pat. No. 4,358,864 to Medrano sets forth a wash basin and commode structure utilizing a recirculating water system.

As such, it may be appreciated that there continues to be a need for a new and improved water conserving shower apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of shower apparatus now present in the prior art, the present invention provides a water conserving shower apparatus wherein the same is arranged for the recirculating of drainage water relative to a shower stall. As such, the general purpose of the present invention, which will be described subsequently in greater detail, is to provide a new and improved water conserving shower apparatus which has all the advantages of the prior art shower apparatus and none of the disadvantages.

To attain this, the present invention provides a shower stall including a drain, wherein the drain includes a slide plate to selectively direct fluid to a sewage or selectively to a reservoir, wherein the reservoir includes a heater and pump assembly therewithin to effect heating and recirculating of the fluid from the reservoir. A modification of the invention includes the shower stall arranged to include a pneumatic or foam filled mattress, wherein the mattress is formed with drainage canals therealong to direct fluid to the floor drain and wherein the shower head is formed as a portion of a manifold assembly slidably directed along the guide tracks to provide for displacement of the shower assembly relative to the shower stall.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water conserving shower apparatus which has all the advantages of the prior art shower apparatus and none of the disadvantages.

It is another object of the present invention to provide a new and improved water conserving shower apparatus which may be easily and efficiently manufactured and marketed.

It is a further object of the present invention to provide a new and improved water conserving shower apparatus which is of a durable and reliable construction.

An even further object of the present invention is to provide a new and improved water conserving shower apparatus which is susceptible of a low cost of manufacture with regard to both materials and labor, and which accordingly is then susceptible of low prices of sale to the consuming public, thereby making such water conserving shower apparatus economically available to the buying public.

Still yet another object of the present invention is to provide a new and improved water conserving shower apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
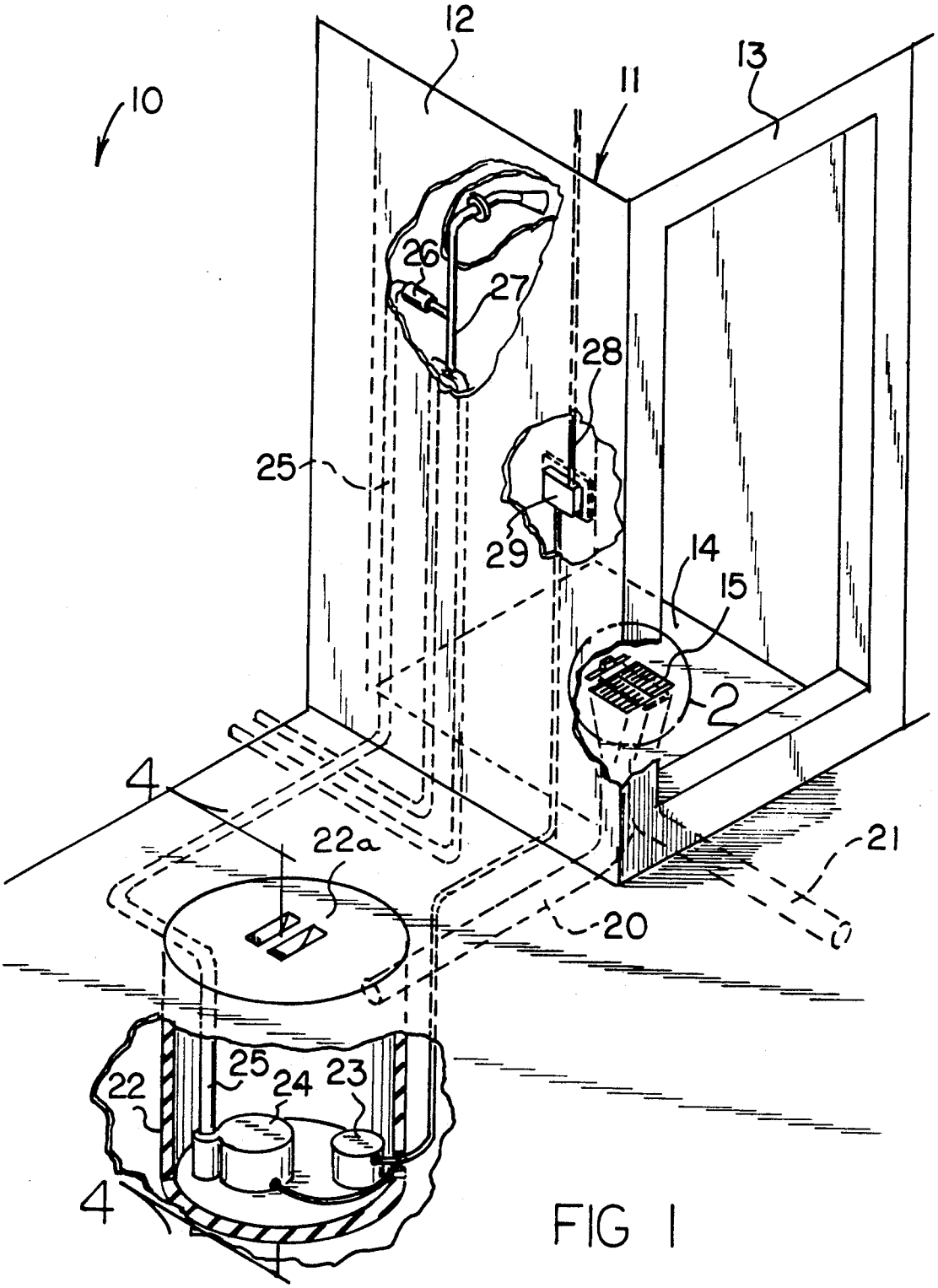
FIG. 1 is an isometric illustration of the instant invention.
Figure 2:
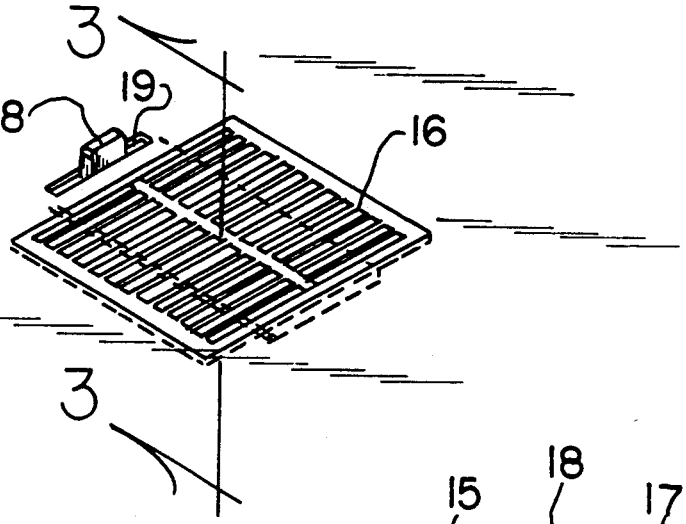
FIG. 2 is an enlarged isometric illustration of section 2, as set forth in FIG. 1.
Figure 3:
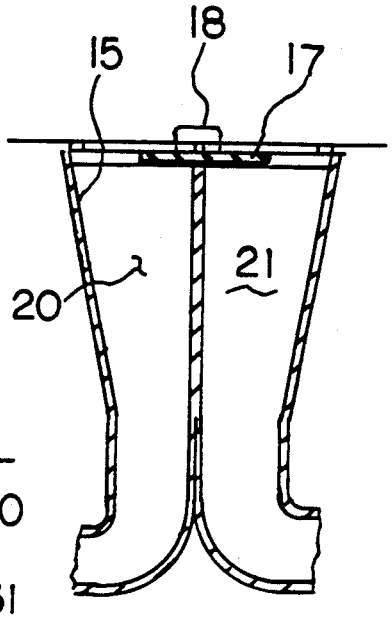
FIG. 3 is a cross-sectional illustration, taken along the lines 3—3 of FIG. 2 in the direction indicated by the arrows.

With reference now to the drawings, and in particular to FIGS. 1 to 7 thereof, a new and improved water conserving shower apparatus embodying the principles and concepts of the present invention and generally designated by the reference numeral 10 will be described.

More specifically, the water conserving shower apparatus 10 of the instant invention essentially comprises a shower stall 11 with at least a first side wall 12 and a front wall 13 including an entrance opening directed therethrough into the shower stall. A floor 14 is positioned at a lower distal end of the wall structure 11 and 12, with a shower head mounted to a free distal end of a water supply conduit 27. The water supply conduit is arranged to conventionally receive a hot and cold water supply through individual conduits utilizing conventional mixing valve structure to direct the thusly mixed water into the water supply conduit 27.

Figure 4:
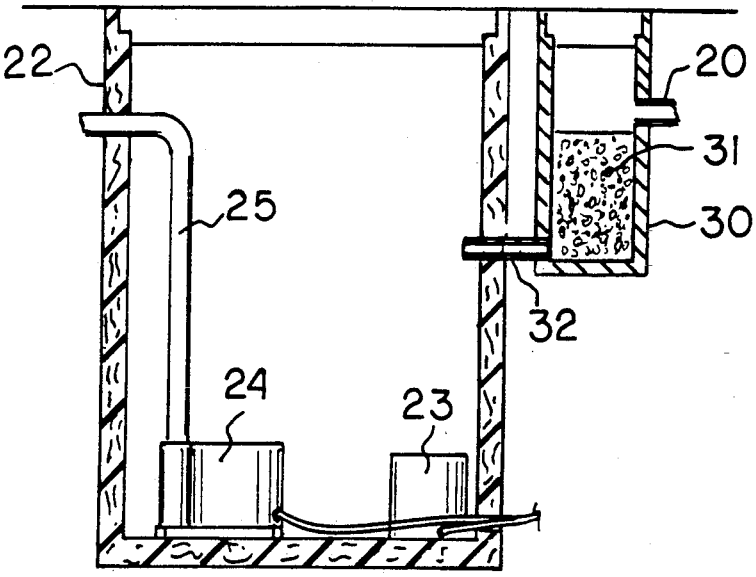
FIG. 4 is an orthographic view, taken along the lines 4—4 of FIG. 1 in the direction indicated by the arrows.
Figure 5:
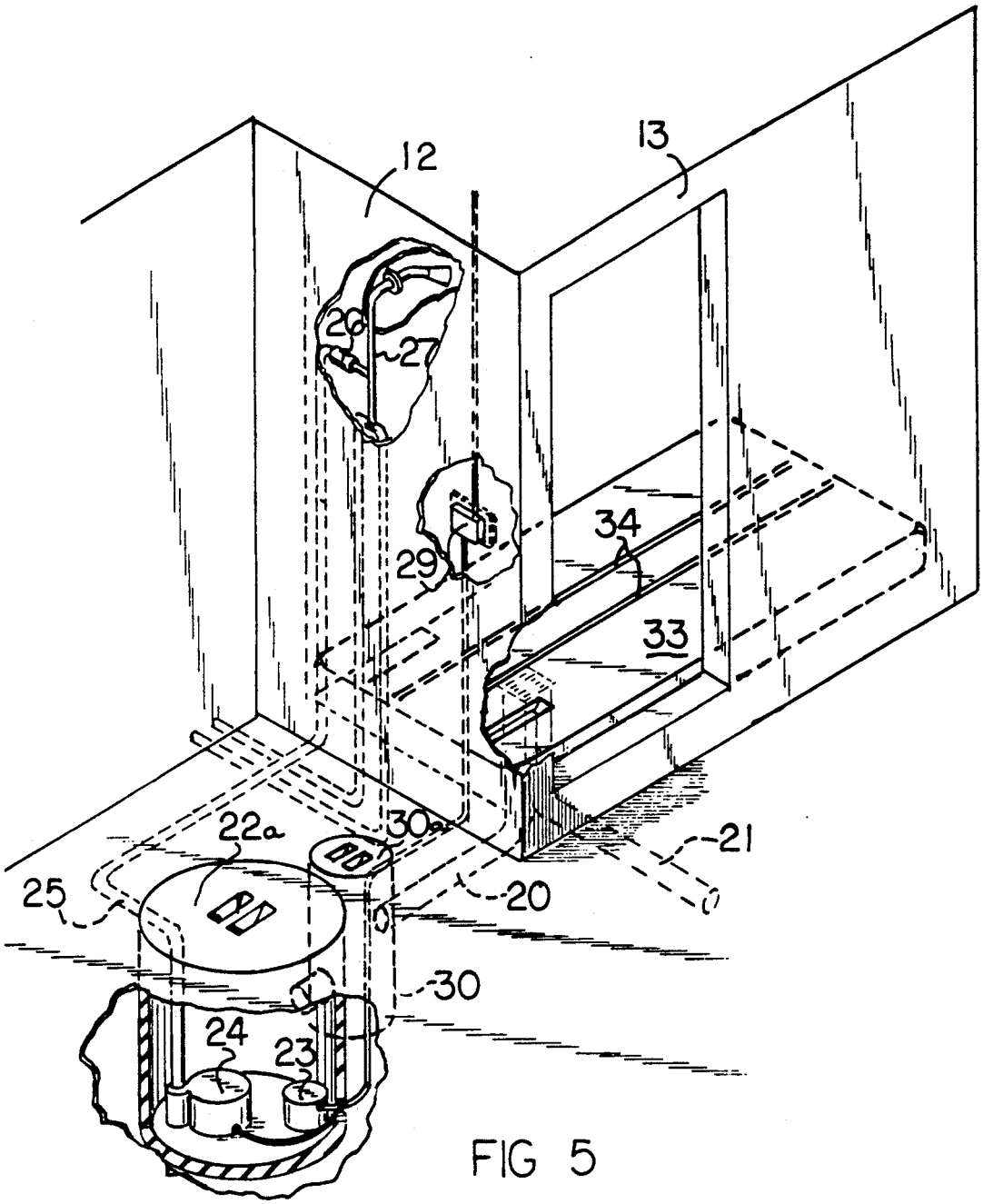
FIG. 5 is an isometric illustration of the invention illustrating the use of a mattress structure utilized in the shower stall.

A drain opening 15 is positioned through the floor 14. The drain opening 15 includes a drain grid 16 mounted at the upper distal end of the drain opening 15, wherein a drain grid includes a drain closure plate 17 slidably mounted below the drain grid over the drain opening 15, with the drain plate 17 including a closure plate handle projecting through a floor slot 19 spaced from the opening 15 to permit displacement of the drain plate 17 relative to the opening 15. The drain plate 17 (see FIGS. 2 and 3) is defined by a width substantially half that of the opening 15. The drain opening 15 is directed into a respective first and second conduit 20 and 21, wherein the drain closure plate 17 is arranged to effect closure selectively of a first or second conduit 20 or 21. The first conduit 20 directs water from the shower head into an associated reservoir tank 22, wherein the second conduit 21 directs water into a sanitary sewer (not shown) and effectively becomes waste water. In this manner, water is selectively directed into the reservoir 22 as required. The reservoir tank 22 includes a reservoir tank lid **22*a* selectively removable relative to an upper distal end of the tank 22 to permit servicing of the tank and its contents. Within the reservoir tank 22 is a heater unit 23 to include a thermostatic control 23*a* (see FIG. 7), either mounted within or exteriorly of the reservoir tank 22 as required for convenience. A pump member 24 is mounted to the floor of the tank 22 to selectively pressurize water from within the reservoir tank and direct that water through a pump outlet conduit 25, with the pump outlet conduit 25 going through a check valve 26 and subsequent to the check valve 26, into the water supply conduit 27. An electrical supply 28 directed into a control unit 29 to include an on/off switch effects selective operation of the pump member 24, as well as the heater unit 23. The FIGS. 4 and 5 illustrate with more clarity the use of a filter housing 30 receiving water from the first conduit 20, with the filter housing 30 including a filter housing removable lid 30*a*. The filter housing includes a charcoal particulate material 31 therewithin, with a filter conduit housing 32 directed from a lower distal end of the filter housing into the reservoir tank 22**.

Figure 6:
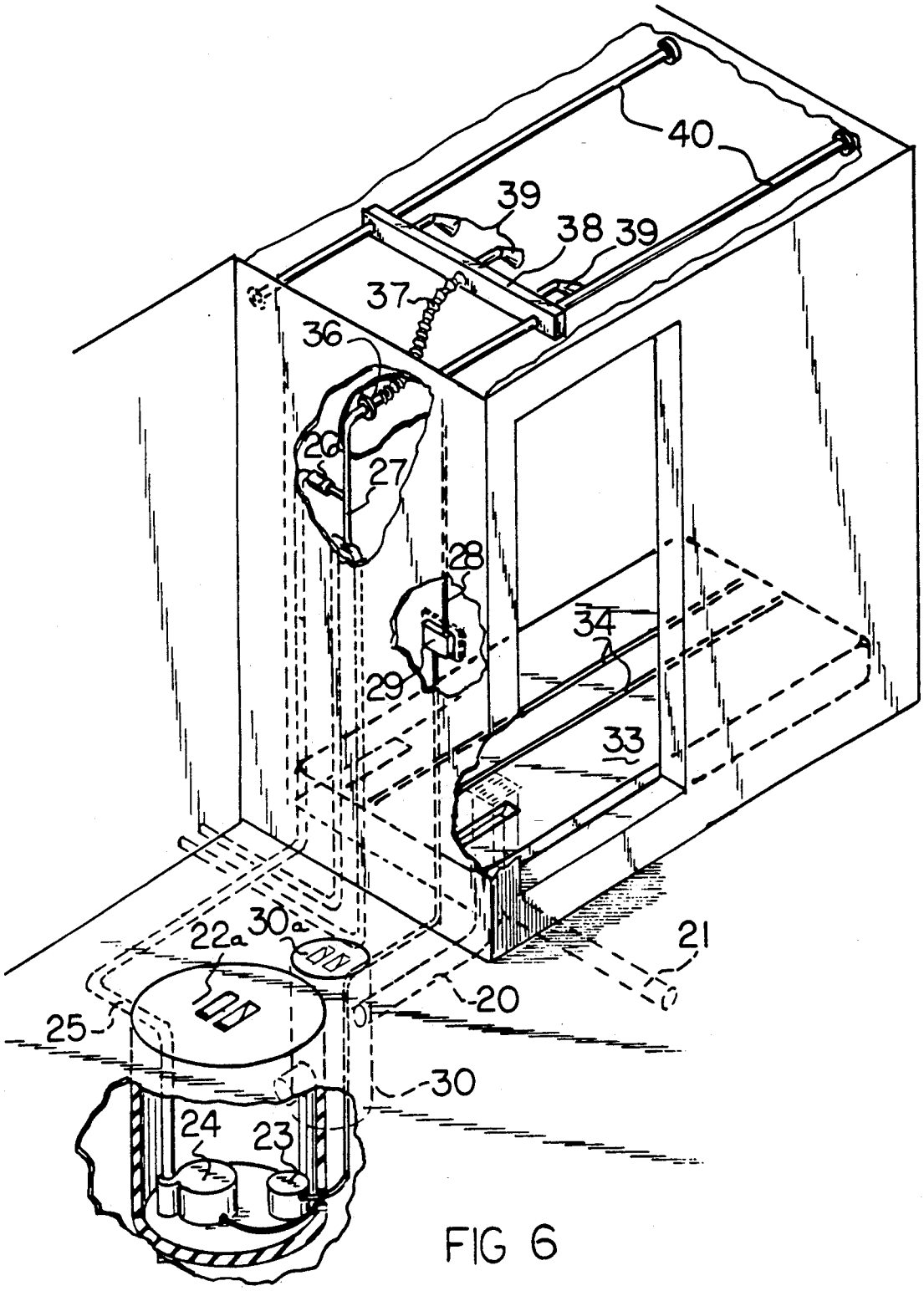
FIG. 6 is an isometric illustration of the invention further utilizing a water manifold and shower head assembly slidably mounted relative to parallel guide tracks positioned over the mattress structure.
Figure 7:
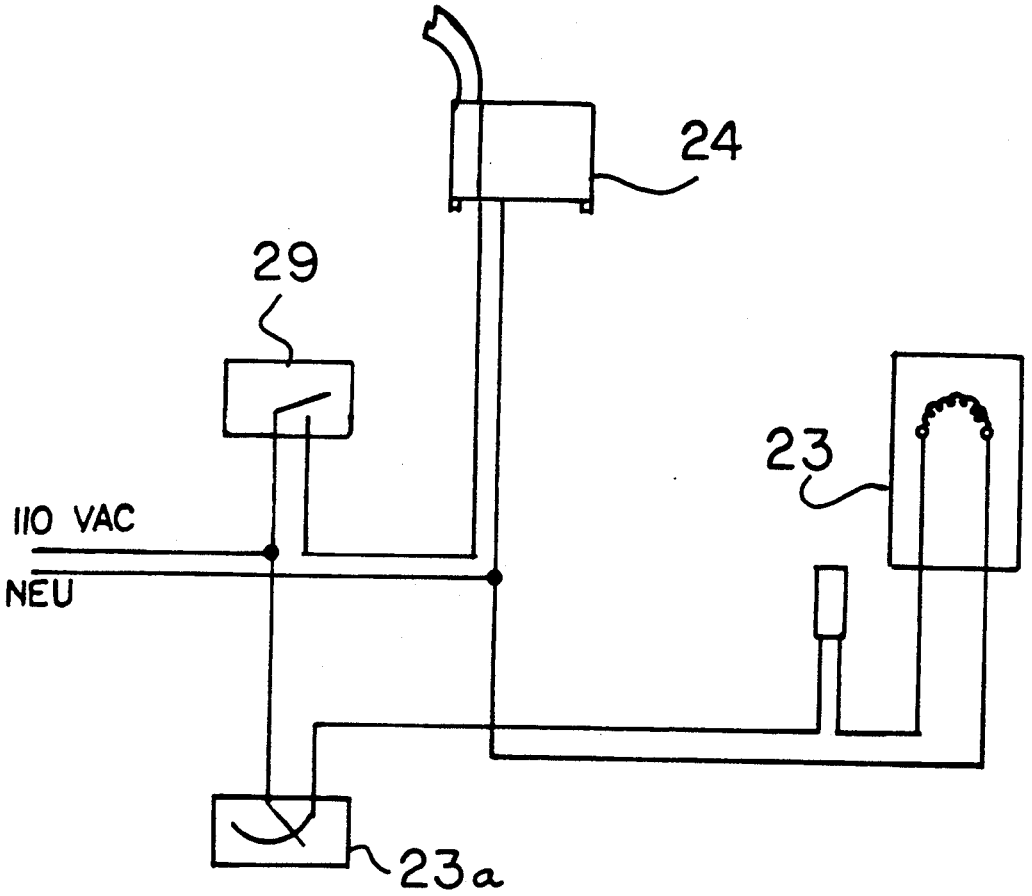
FIG. 7 is a diagrammatic illustration of the electrical components utilized in the invention.

The FIG. 5, as well as the FIG. 6, includes the use of a mattress 33 mounted onto the floor 14 of the shower stall 11. The mattress 33 may alternatively be formed of a foam-like material to permit the shower stall to comfortably accommodate individuals in a lying position and minimize injury during use of the shower stall structure. Mattress drainage grooves 34 are directed along the surface of the mattress to direct the water to the drain opening 15. The pump outlet conduit 25 and the associated water supply conduit 27 terminate in a water supply conduit coupling 36, with an extensible accordion pleated conduit 37 extending from the coupling 36 to a fluid manifold 38. The fluid manifold 38 includes a plurality of shower heads 39 thereon, wherein the manifold 38 slidably receives a plurality of parallel track rods 40 therethrough, wherein the track rods are mounted to an upper distal end of the shower stall to permit adjustable orientation of the manifold and the shower heads 38 and 39 respectively throughout the shower stall structure.

It should be further noted that the thermostat **23*a* is arranged for multiple temperature settings to control temperature within the reservoir through the heater member 23**. Further, it may be desired to include a water temperature indicator in cooperation with a float valve mounted to an upper distal end of the reservoir, such is typically utilized in various filling structures, such as in a commode, to effect selective cessation of fluid flow into the reservoir when full. Further it should be noted that the reservoir as well as the filter housing may include drainage plugs to permit ease of drainage of the reservoirs during servicing of the reservoirs.

Accordingly, various modifications may be utilized in the scope of the invention without departing from the spirit and scope of the invention, and accordingly it may be appreciated that the manner of usage of the instant invention should be apparent from the above disclosure and no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water conserving shower apparatus, comprising, a shower stall, the shower stall including at least one side wall and a front wall adjacent the at least one side wall, with the front wall including an entrance opening directed therethrough into the shower stall, with the shower stall further including a floor, the floor including a drain opening, the drain opening positioned above a first conduit and a second conduit, and the first conduit directed into a reservoir tank, and the second conduit directed into disposal of water directed into the second conduit, and the reservoir tank including a pump member contained therewithin, and the pump member including a pump outlet conduit, the pump outlet conduit directed from the reservoir tank to the shower stall, the shower stall further including a water supply conduit, with the pump outlet conduit in fluid communication with the water supply conduit, the water supply conduit including a shower head in fluid communication with the water supply conduit, and the first conduit includes a filter housing in fluid communication with the first conduit, wherein the filter housing includes a filter housing lid selectively removable relative to the filter housing for servicing of components within the filter housing, wherein the filter housing includes a charcoal particulate material contained therewithin for filtration of water directed therethrough, and the filter housing includes a filter housing conduit, the filter housing conduit in fluid communication with the filter housing and directed into the reservoir conduit, and the reservoir conduit includes a heater assembly contained therewithin, the heater assembly includes a thermostat control to maintain a predetermined temperature gradient within the reservoir tank, and control means mounted to the shower stall for effecting selective actuation of the heater unit and the pump member, and the drain opening includes a drain grid extending over the drain opening, and positioned adjacent to and below the drain opening is a drain closure plate, the drain opening defined by a predetermined width, wherein the drain closure plate is defined by a further width substantially equal to one-half the predetermined width, and wherein the first conduit is defined by one-half the predetermined width and the second conduit is defined by one-half the predetermined width, and the drain closure plate is arranged for sliding displacement selectively above the first conduit and the second conduit to direct selective fluid flow to the first conduit or the second conduit.

2. An apparatus as set forth in claim 1 wherein the drain closure plate includes a drain closure plate handle spaced from the drain opening, and the drain closure plate handle is slidably mounted within a floor slot spaced from the drain opening to limit displacement of the drain plate relative to the drain opening.

3. An apparatus as set forth in claim 2 wherein the shower stall floor includes a pneumatic mattress mounted to the shower stall floor, wherein the pneumatic mattress includes a plurality of drainage grooves directing fluid to the drain opening.

4. An apparatus as set forth in claim 3 wherein the water supply conduit includes a water supply conduit coupling, the water supply conduit coupling including an extensible accordion pleated conduit extending from the water supply coupling, and the accordion pleated conduit extending from the coupling to a fluid manifold, the fluid manifold mounted fixedly to the outer terminal end of the accordion pleated conduit spaced from the water supply conduit coupling, and the fluid manifold includes a plurality of further shower heads in addition to the shower head mounted in fluid communication with the fluid manifold, and a plurality of parallel tracks are mounted to the shower stall adjacent an upper distal end of the at least one side wall, with the parallel tracks slidably received through the fluid manifold.

5. An apparatus as set forth in claim 4 including a check valve mounted in fluid communication with the pump outlet conduit to prevent fluid flow from the water supply conduit into the pump outlet conduit.

* * * * *